US009908356B2

(12) United States Patent
Kuo et al.

(10) Patent No.: US 9,908,356 B2
(45) Date of Patent: Mar. 6, 2018

(54) CARBONLESS COPY NOTE PAD

(71) Applicant: Taiwan Hopax Chemicals Mfg. Co., LTD., Kaohsiung (TW)

(72) Inventors: Tsung-Tien Kuo, Kaohsiung (TW); Hsien-Min Kuo, Kaohsiung (TW); Ho-Tsai Lin, Kaohsiung (TW); Ming-Yang Li, Nantou County (TW)

(73) Assignee: Taiwan Hopax Chemicals Mfg. Co., LTD., Kaohsiung (TW)

( * ) Notice: Subject to any disclaimer, the term of this patent is extended or adjusted under 35 U.S.C. 154(b) by 262 days.

(21) Appl. No.: 14/730,273

(22) Filed: Jun. 4, 2015

(65) Prior Publication Data

US 2016/0200128 A1 Jul. 14, 2016

(30) Foreign Application Priority Data

Jan. 8, 2015 (TW) ..... 104100547 A

(51) Int. Cl.

| | |
|---|---|
| ***B42D 5/00*** | (2006.01) |
| ***B41L 1/24*** | (2006.01) |
| ***B41L 1/36*** | (2006.01) |
| ***B42D 11/00*** | (2006.01) |
| ***B41M 5/124*** | (2006.01) |

(52) U.S. Cl.

CPC ..... *B41L 1/24* (2013.01); *B41L 1/36* (2013.01); *B41M 5/124* (2013.01); *B41M 5/1243* (2013.01); *B42D 5/003* (2013.01)

(58) Field of Classification Search

CPC ..... B42D 5/00; B42D 5/003; B42D 11/00; B41L 1/24; B41M 5/124

USPC ..... 462/902

See application file for complete search history.

(56) References Cited

U.S. PATENT DOCUMENTS

| | | | | | |
|---|---|---|---|---|---|
| 3,104,980 | A * | 9/1963 | Maierson | B41M 5/124 | 462/69 |
| 3,481,759 | A * | 12/1969 | Ostlie | B41M 5/132 | 462/69 |
| 4,036,511 | A | 7/1977 | Maalouf | | |
| 4,448,445 | A * | 5/1984 | Chang | B41M 5/124 | 462/69 |
| 5,223,473 | A * | 6/1993 | Oliver | B41M 5/124 | 427/152 |
| 5,334,094 | A | 8/1994 | Armbruster | | |
| 5,863,629 | A * | 1/1999 | Kuo | B41L 1/36 | 462/72 |

(Continued)

FOREIGN PATENT DOCUMENTS

| | | | | |
|---|---|---|---|---|
| DE | 2600743 A1 * | 7/1977 | ..... | B41L 1/36 |
| EP | 0589765 A1 | 3/1994 | | |

(Continued)

*Primary Examiner* — Kyle Grabowski
(74) *Attorney, Agent, or Firm* — LeClairRyan

(57) ABSTRACT

A carbonless copy note pad includes a stack of note sheet sets. Each of note sheet sets includes first and second paper sheets, first and second adhesive layers, a color-developing coating layer, and a coarse particle coating layer. The color-developing coating layer is formed on at least one of the first and second paper sheets. The coarse particle coating layer is formed on a lower surface of the second paper sheet, and has a roughened surface to prevent a scribbling pressure applied to a writing surface of the first paper sheet of a topmost one of the note sheet sets from affecting a next one of the note sheet sets.

17 Claims, 12 Drawing Sheets

(56) References Cited

U.S. PATENT DOCUMENTS

| | | | |
|---|---|---|---|
| 6,217,443 | B1 | 4/2001 | Green, Jr. |
| 2012/0015174 | A1 | 1/2012 | Kuo et al. |
| 2012/0100988 | A1 | 4/2012 | Kuo et al. |

FOREIGN PATENT DOCUMENTS

| | | | |
|---|---|---|---|
| EP | 0620121 | A2 | 10/1994 |
| JP | 2009-248519 | A | 10/2009 |
| TW | 420640 | B | 2/2001 |
| WO | 98/4331 | A1 | 4/1998 |

* cited by examiner

CARBONLESS COPY NOTE PAD

CROSS-REFERENCE TO RELATED APPLICATION

This application claims priority from Taiwanese application no. 104100547, filed on Jan. 8, 2015, the disclosure of which is incorporated in its entirety herein by reference.

FIELD OF THE INVENTION

This invention relates to a note pad, and more particularly to a carbonless copy note pad.

BACKGROUND OF THE INVENTION

Conventional carbonless copy note pads include a plurality of carbonless copy paper sets. Each set may include a writing paper sheet and one to six copy paper sheets. FIGS. 1A and 1B show a conventional carbonless copy note pad 9 with two copy paper sheets in each set.

The conventional carbonless copy note pad 9 includes a topmost note sheet set 91, a next-to-topmost note sheet set 92, a bottommost note sheet set 94, and a plurality of intervening note sheet sets 93. The note sheet sets 91, 92, 93, 94 are bonded together at one side edge by gluing. As shown, each of the note sheet sets 91, 92, 93, 94 includes a writing paper sheet 901, upper and lower copy paper sheets 902, 903, and a color-developing coating layer (not shown) which is disposed such that when a user writes a message on the writing paper sheet 901 of the topmost note sheet set 91, a replica of the message is formed on an upper surface of each of the upper and lower copy paper sheets 902, 903 of the topmost note sheet set 91. To prevent the writing from acting on the next-to-topmost note sheet set 92, a separate cardboard divider 8 need be placed between the topmost note sheet set 91 and the next-to-topmost note sheet set 92, i.e., between the lower copy paper sheet 903 of the topmost note sheet set 91 and the writing paper sheet 901 of the next-to-topmost note sheet set 92, which is very inconvenient. Thus, there is a need for a novel carbonless copy note pad which can be conveniently used without the need for a cardboard divider 8.

Co-pending U.S. application Ser. No. 13/038,128, filed Mar. 1, 2011 and entitled "NOTE PAD CONTAINING CARBONLESS COLOR-DEVELOPING MATERIAL," discloses a note pad that includes carbonless note sheets capable of developing an image or mark when a pressure is applied thereto.

SUMMARY OF THE INVENTION

Therefore, an object of the present invention is to provide a novel carbonless copy note pad including a plurality of note sheet sets, each of the note sheet sets include two or more paper sheets. A coarse particle coating layer is formed on the last sheet of every note sheet set. With the provision of the coarse particle coating layer, transfer of a writing on a topmost one of the note sheet sets to the sheets of all the note sheet sets below the topmost note sheet set can be effectively prevented. In other words, even if no separate cardboard divider is provided below the topmost one of the note sheet sets during writing, the remaining note sheet sets remain unaffected.

According to a first aspect of the present invention, a carbonless copy note pad includes a stack of note sheet sets each of which includes first and second paper sheets, a color-developing coating layer, and a coarse particle coating layer. The first paper sheet has a writing surface and a back surface opposite to the writing surface. The second paper sheet has an upper surface to face the back surface of the first paper sheet, and a lower surface opposite to the upper surface. The color-developing coating layer is formed on at least one of the first and second paper sheets. The coarse particle coating layer is formed on the lower surface of the second paper sheet, and has a roughened surface such that a scribbling pressure resulting from a scribbling movement on the writing surface of the first paper sheet is dispersed so as to prevent the scribbling pressure from acting on the next one of the note sheet sets.

According to a second aspect of the present invention, a carbonless copy note pad includes a stack of note sheet sets each of which includes first and second paper sheets, a first adhesive layer, a color-developing coating layer, and a coarse particle coating layer. The first paper sheet has a writing surface and a back surface opposite to the writing surface. The second paper sheet has an upper surface to face the back surface of the first paper sheet, and a lower surface opposite to the upper surface. The first adhesive layer is permanently bonded to the back surface of the first paper sheet, and is releasably attached to the upper surface of the second paper sheet. The color-developing coating layer is formed on at least one of the first and second paper sheets. The coarse particle coating layer is formed on the lower surface of the second paper sheet, and has a roughened surface such that a scribbling pressure resulting from a scribbling movement on the writing surface of the first paper sheet is dispersed so as to prevent the scribbling pressure from acting on the next one of the note sheet sets. Preferably, each of the first and second paper sheets has a side edge. The side edges of the first and second paper sheets of the note sheet sets are flush with each other, and are bonded together by glue.

BRIEF DESCRIPTION OF THE DRAWINGS

Other features and advantages of the present invention will become apparent in the following detailed description of the embodiments of the invention, with reference to the accompanying drawings, in which.

DETAILED DESCRIPTION OF THE EMBODIMENTS

Figure 1A:
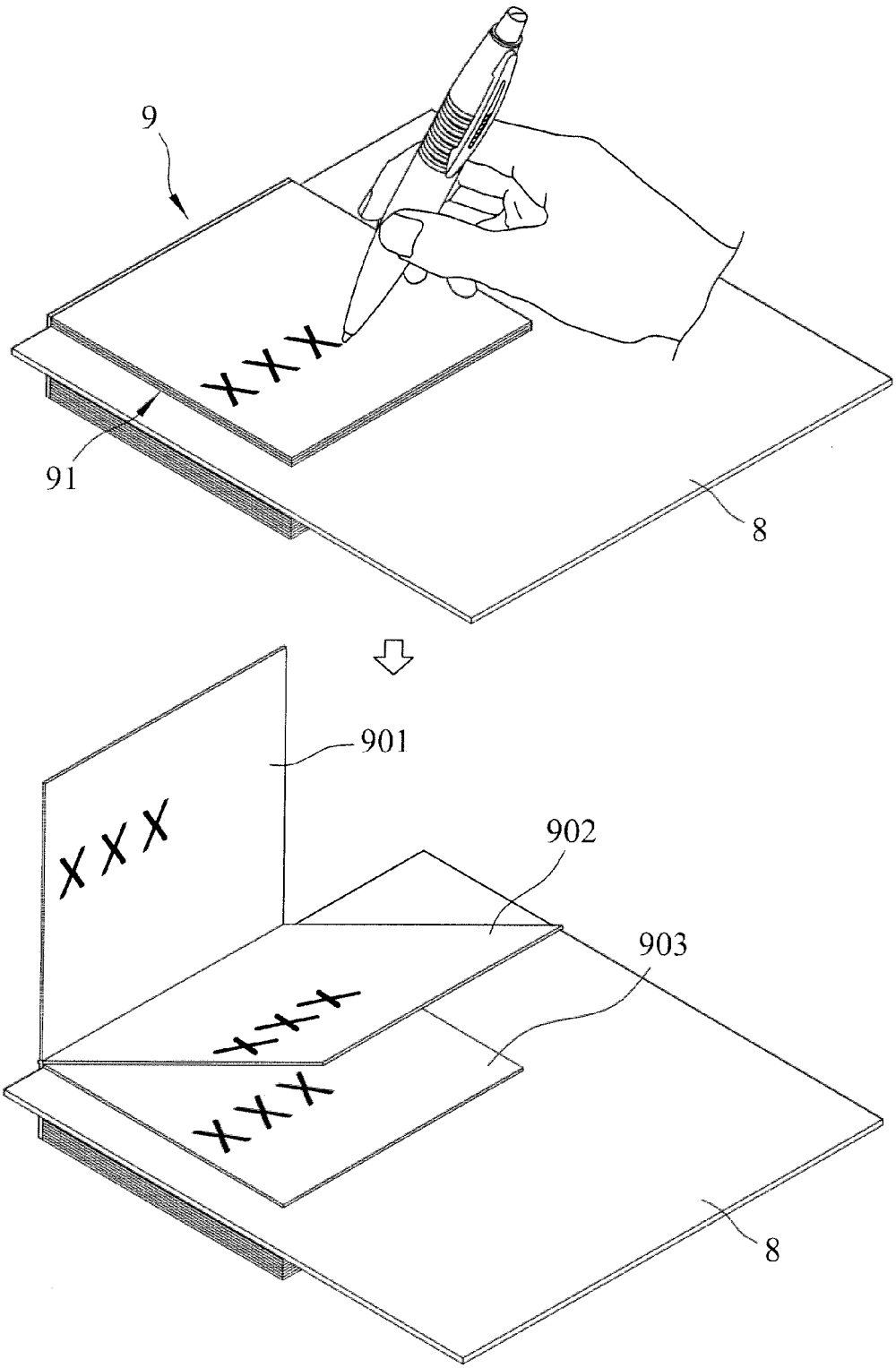
FIG.1A PRIOR ART
FIGS. 1A and 1B are perspective views of a conventional carbonless copy note pad.
Figure 1B:
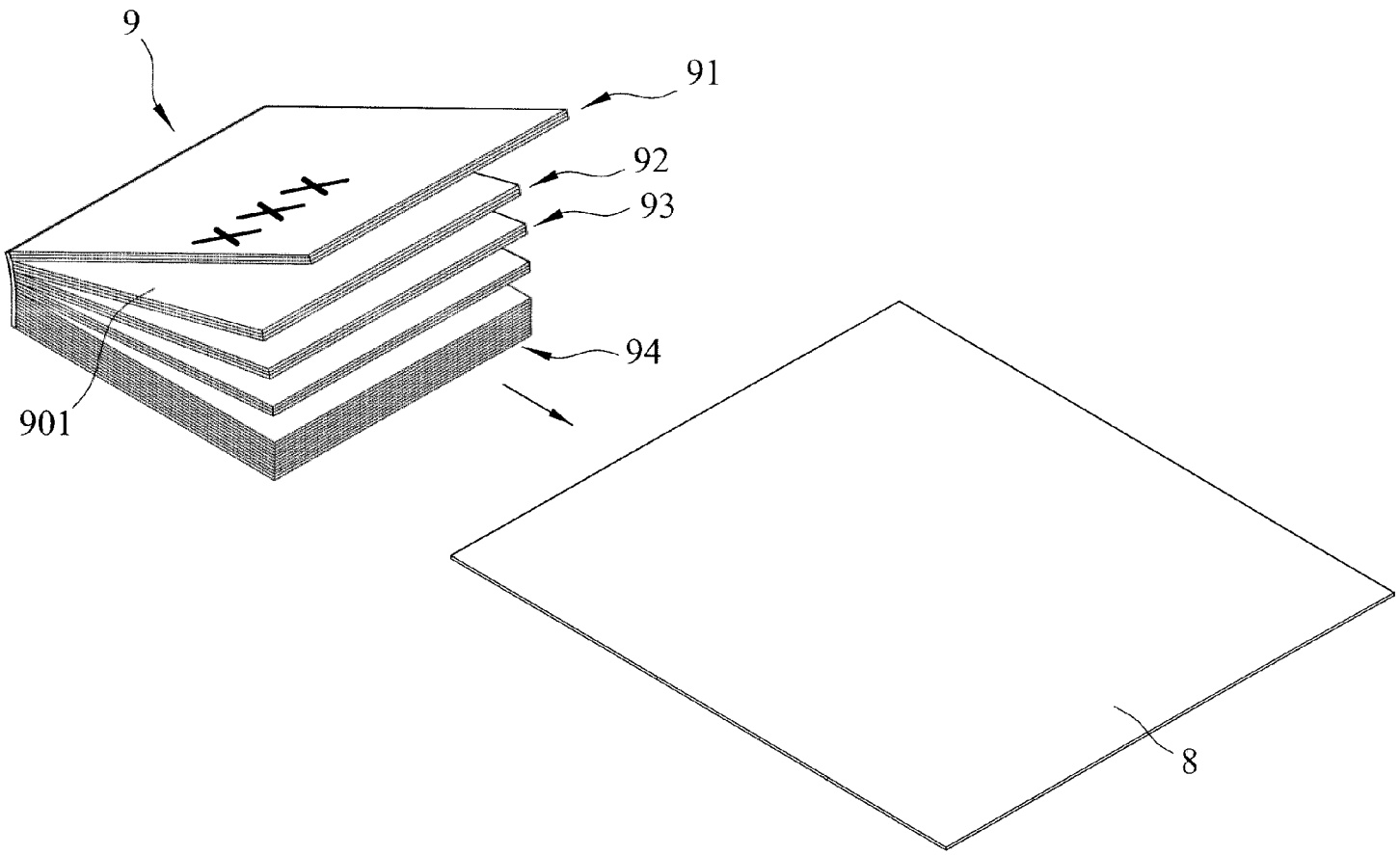
FIG.1B PRIOR ART

Before the present invention is described in greater detail, it should be noted herein that same reference numerals are used to denote like elements throughout the specification.

With reference to FIGS. 2 to 5, a carbonless copy note pad 1 according to a first embodiment of the present invention includes a stack of note sheet sets 10.

Each of the note sheet set 10 includes a first paper sheet 11, a second paper sheet 12, a color-developing coating layer 2, a coarse particle coating layer 4, and first and second adhesive layer 31, 33.

The first paper sheet 11 has a writing surface ill and a back surface 112 opposite to the writing surface 111, and includes a first flippable part 113 and a first re-adherable part 114.

The second paper sheet 12 has an upper surface 121 to face the back surface 112 of the first paper sheet 11, and a lower surface 122 opposite to the upper surface 121. The second paper sheet 12 includes a second flippable part 123 and a second re-adherable part 124.

Each of the first and second paper sheets 11, 12 may have a width or length ranging from 30 mm to 200 mm, and may be rectangular or square in shape. The carbonless copy note pad may have a standard size such as 38 mm×51 mm, 76 mm×51 mm, 76 mm×76 mm, 76 mm×127 mm, 150 mm×105 mm or 152 mm×100 mm, etc. The size and shape of the carbonless copy note pad may vary depending on the intended use thereof.

The first adhesive layer 31 is coated on the first re-adherable part 114 at the back surface 112 of the first paper sheet 11, and is releasably attached to the second re-adherable part 124 at the upper surface 121 of the second paper sheet 12, such that the first flippable part 113 of the first paper sheet 11 is flippable while the first re-adherable part 114 is attached to the second paper sheet 12. The second adhesive layer 33 is coated on the second re-adherable part 124 at the lower surface 122 of the second paper sheet 12, and is releasably attached to a next one of the note sheet sets 10, such that the second flippable part 123 of the second paper sheet 12 is flippable while the second re-adherable part 124 is attached to the next one of the note sheet sets 10. Each of the first and second adhesive layers 31, 33 is made of a pressure sensitive adhesive material.

The color-developing coating layer 2 is formed on at least one of the first and second paper sheets 11, 12, and includes a plurality of microcapsules 211 and a carbonless color-developing material 221. Each of the microcapsules 211 includes a microshell and a reactive dye enclosed inside the microshell and is rupturable. The reactive dye may be crystal violet lactone (CVL), and the microshell may be made from an amino-containing resin or gelatin.

In this embodiment, the color-developing coating layer 2 is formed on the second paper sheet 12, and includes a microcapsule sublayer 21 having the microcapsules 211, and a color-developing sublayer 22 having the carbonless color-developing material 221. The microcapsule sublayer 21 has the microcapsules 211 in an amount ranging from 1.2 g/m$^2$ to 3.0 g/m$^2$. The microcapsules 211 have particle sizes ranging from 2.0 μm to 6.0 μm. The carbonless color-developing material 221 may include phenolic resins, active clay, and/or salicylic acid resins.

The color-developing sublayer 22 is formed on the upper surface 121 of the second paper sheet 12, and the microcapsule sublayer 21 is formed on the color-developing sublayer 22. The first adhesive layer 31 is releasably attached to the second re-adherable part 124 with the color-developing coating layer 2 disposed therebetween.

Figure 4:
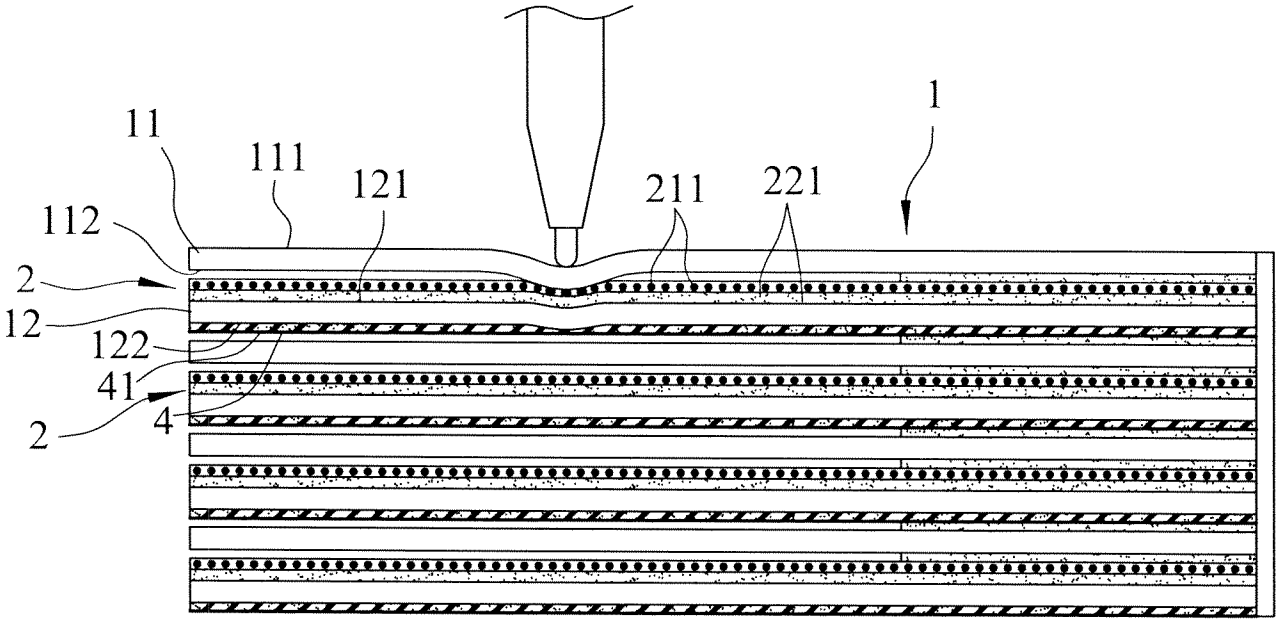
FIG. 4 illustrates that a scribbling pressure is applied to a top one of note sheet sets of the carbonless copy note pad of FIG. 2 using a writing instrument.
Figure 5:
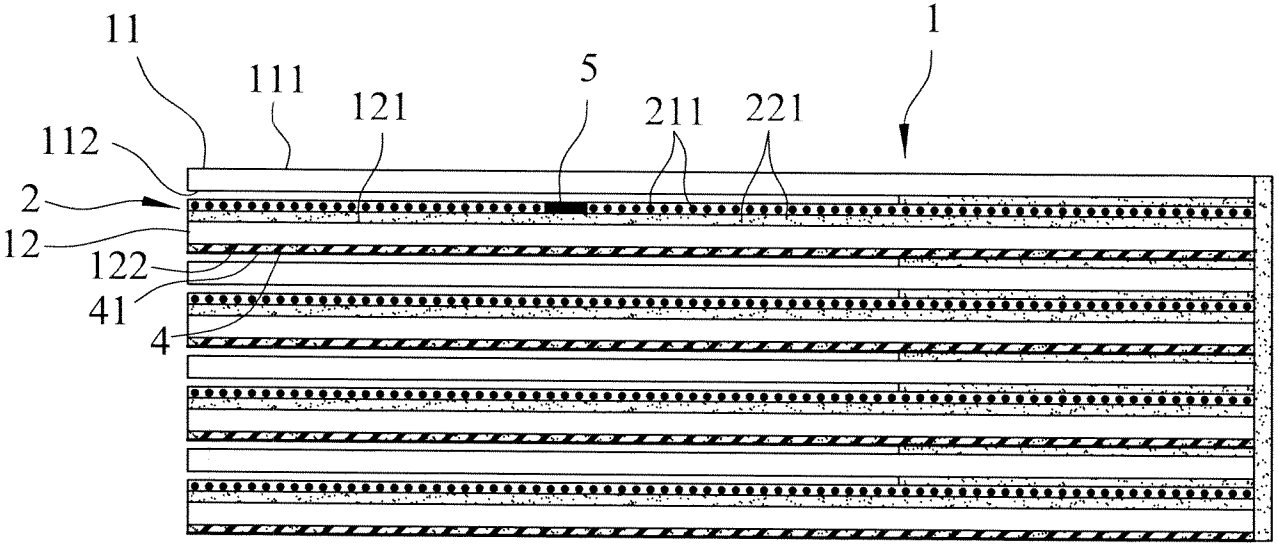
FIG. 5 illustrates that a mark is formed on a second paper sheet of the top one of the note sheet sets in the carbonless copy note pad of FIG. 4 in response to the scribbling pressure.

With reference to FIGS. 4 and 5, as a user jots-down a message (i.e., makes a scribbling movement) on the writing surface 111 of the first paper sheet 11, a scribbling pressure resulting from the scribbling movement is applied to the color-developing coating layer 2 therebeneath, such that corresponding ones of the microcapsules 211 in the color-developing coating layer 2 rupture to release the reactive dye therein, which reacts with the carbonless color-developing material 221 to exhibit a colored mark 5, which is a replica of the message, on the second paper sheet 12.

The coarse particle coating layer 4 is a coarse particle-containing binder layer, and is formed on the lower surface 122 of the second paper sheet 12, and has a roughened surface 41 such that the scribbling pressure resulting from the scribbling movement on the writing surface 111 of the first paper sheet 11 and transferred thereto is dispersed so as to prevent the scribbling pressure from acting on the next one of the note sheet sets 10 (see FIG. 4).

The roughened surface 41 of the coarse particle coating layer 4 has a roughness not less than 5 μm. The coarse particle coating layer 4 includes a binder and a plurality of coarse particles dispersed in the binder.

The coarse particles are made from pigment or filler. The coarse particles have particle sizes not less than 20 μm. In this embodiment, the particle sizes of the coarse particles range from 40 μm to 120 μm.

More particularly, the coarse particle coating layer 4 includes the coarse particles, the binder, clay, and calcium carbonate. The binder may include a starch-based binder, a polyvinyl alcohol-based binder and/or a latex-based binder. The presence of the coarse particles in the coarse particle coating layer 4 can increase surface coarseness (roughness). The roughened surface 41 of the coarse particle coating layer 4 provides an increased surface area that helps disperse the scribbling pressure throughout the coarse particle coating layer 4 to advantageously prevent the microcapsules 211 in the next one of the note sheet sets 10 from rupturing. The amount of the coarse particles can be adjusted for varying the roughness of the roughened surface 41, and may range from 0.1 wt % to 95 wt % based on the total weight of the coarse particle coating layer 4.

In this embodiment, a first bonding force between the first adhesive layer 31 and the second re-adherable part 124 is greater than a second bonding force between the second adhesive layer 33 and the next one of the note sheet sets 10. Thus, the topmost one of the note sheet sets 10 can be easily torn away from the remaining note sheet sets 10.

Figure 2:
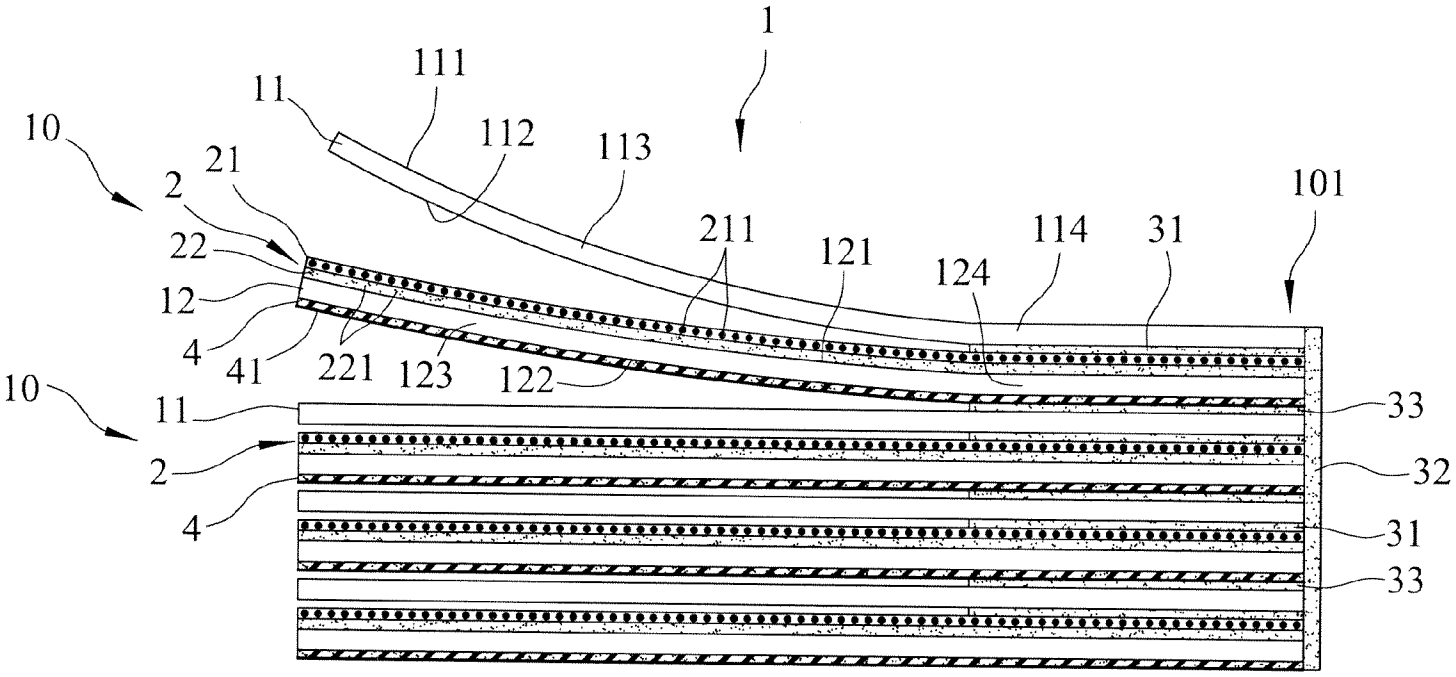
FIG. 2 is a cross-sectional view of a carbonless copy note pad according to a first embodiment of the present invention.
Figure 3:
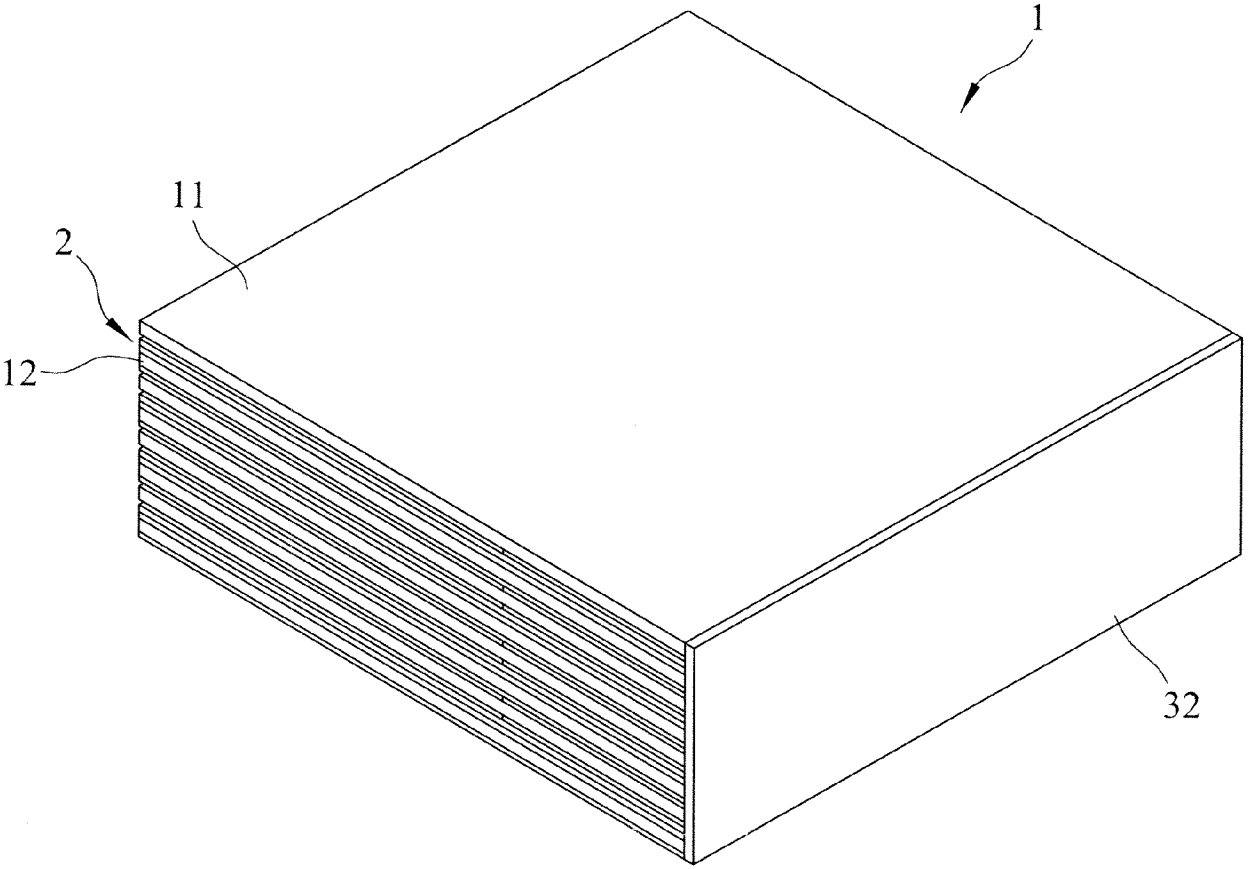
FIG. 3 is a perspective view of the carbonless copy note pad of FIG. 2.

The note sheet sets 10 each have a side edge 101 flush with each other and are bonded together at the side edges 101 by gluing, e.g., by a glue layer 32 (see FIG. 2).

Figure 6:
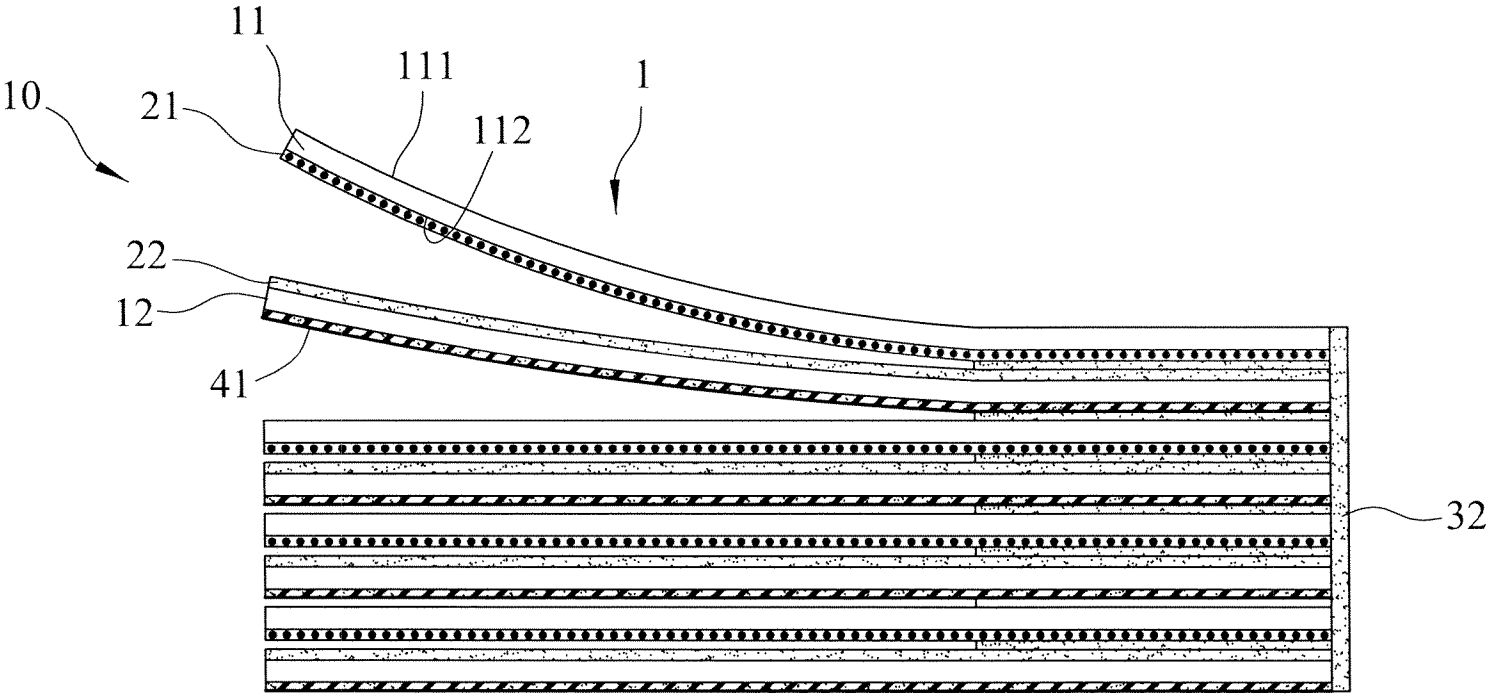
FIG. 6 is a cross-sectional view of a carbonless copy note pad according to a second embodiment of the present invention.

FIG. 6 shows a carbonless copy note pad 1 according to a second embodiment of the present invention. The second embodiment is similar to the first embodiment except that the microcapsule sublayer 21 is formed on the back surface 112 of the first paper sheet 11.

Figure 7:
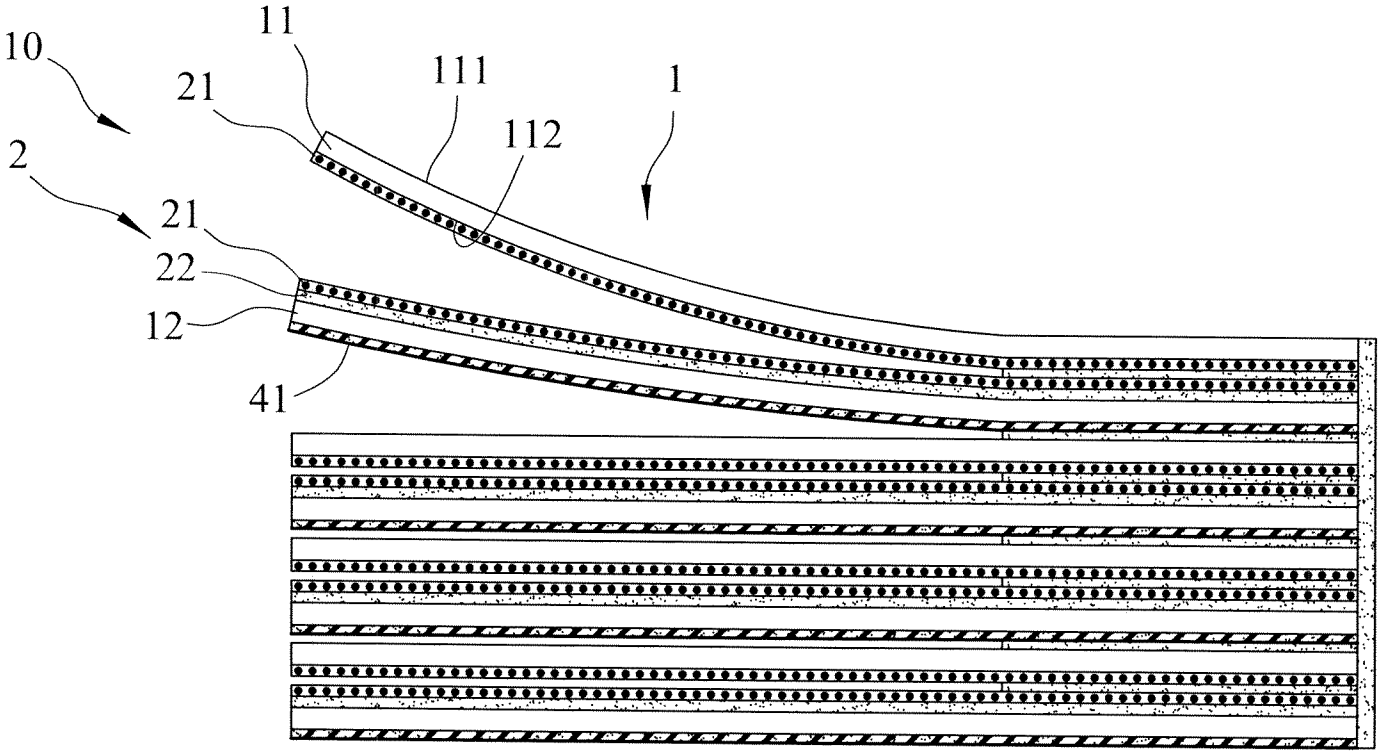
FIG. 7 is a cross-sectional view of a carbonless copy note pad according to a third embodiment of the present invention.

FIG. 7 shows a carbonless copy note pad 1 according to a third embodiment of the present invention. The third embodiment is similar to the first embodiment except that the color-developing coating layer 2 includes two of the microcapsule sublayers 21, one of which is formed on the back surface 112 of the first paper sheet 11, and the other of which is formed on the color-developing sublayer 22 on the second paper sheet 12.

Figure 8:
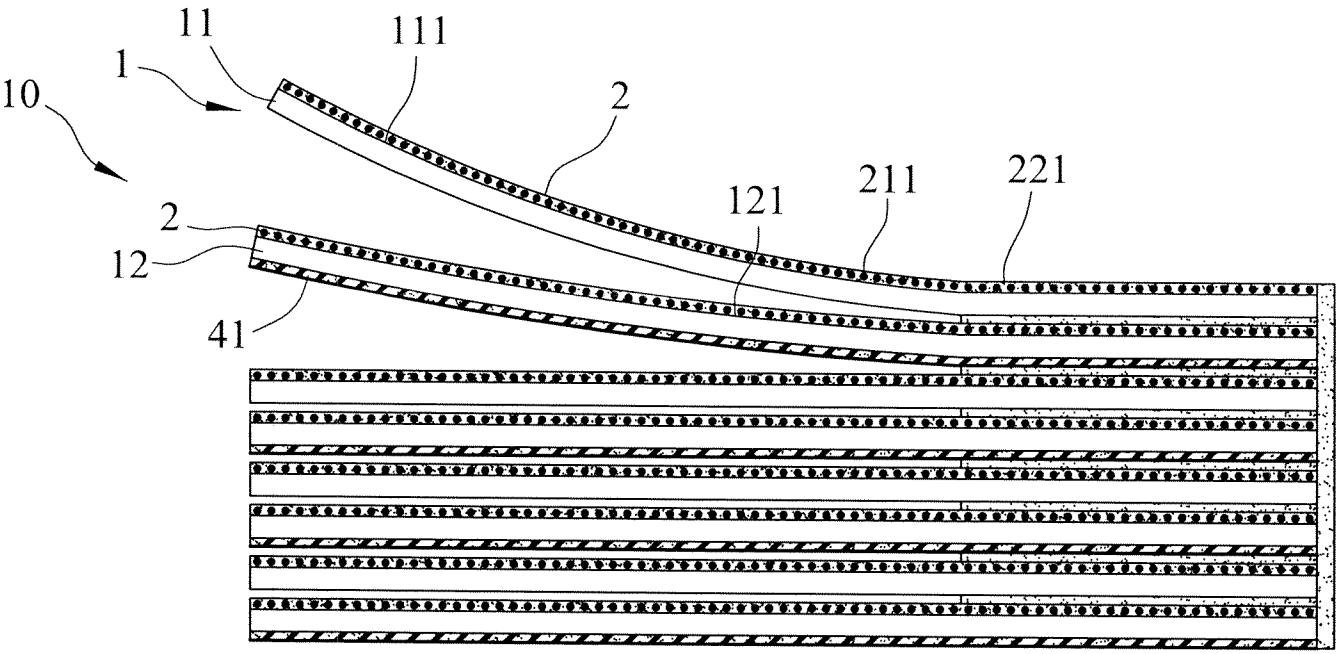
FIG. 8 is a cross-sectional view of a carbonless copy note pad according to a fourth embodiment of the present invention.

FIG. 8 shows a carbonless copy note pad 1 according to a fourth embodiment of the present invention. The fourth embodiment is similar to the first embodiment except that each of the note sheet sets 10 includes two of the color-developing coating layers 2, one of which is formed on the writing surface 111 of the first paper sheet 11, and the other of which is formed on the upper surface 121 of the second paper sheet 12. Each of the color-developing coating layers 2 is a single layer including the microcapsules 211 and the carbonless color-developing material 221.

The fourth embodiment allows a user to write down a message and make a copy thereof even if no writing instrument is at hand. For instance, the user may use a finger or a pointed object such as a stylus to "write" a message by applying a scribbling pressure to the color-developing coating layer 2 on the writing surface 111 of the first paper sheet 11, with a replica of the message formed on the upper surface 121 of the second paper sheet 12.

Figure 9:
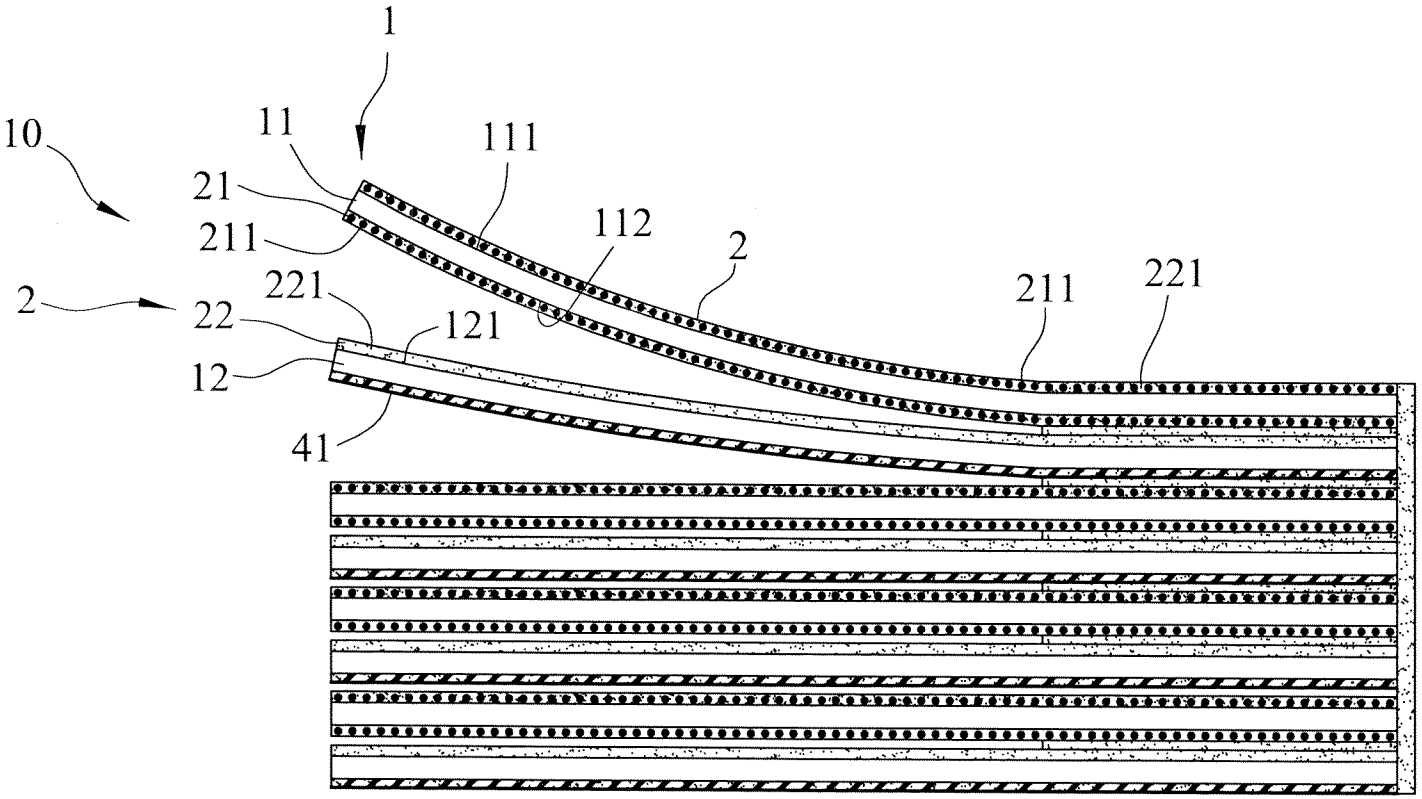
FIG. 9 is a cross-sectional view of a carbonless copy note pad according to a fifth embodiment of the present invention.

FIG. 9 shows a carbonless copy note pad 1 according to a fifth embodiment of the present invention. The fifth embodiment is similar to the fourth embodiment. In this embodiment, the color-developing coating layer 2, which is formed on the writing surface 111 of the first paper sheet 11, is a single layer including the microcapsules 211 and the carbonless color-developing material 221.

The color-developing coating layer 2, which is formed on the upper surface 121 of the second paper sheet 12, includes a microcapsule sublayer 21 having the microcapsules 211 and a color-developing sublayer 22 having the carbonless color-developing material 221. The color-developing sublayer 22 is formed on the upper surface 121 of the second paper sheet 12, and the microcapsule sublayer 21 is formed on the color-developing sublayer 22.

Figure 10:
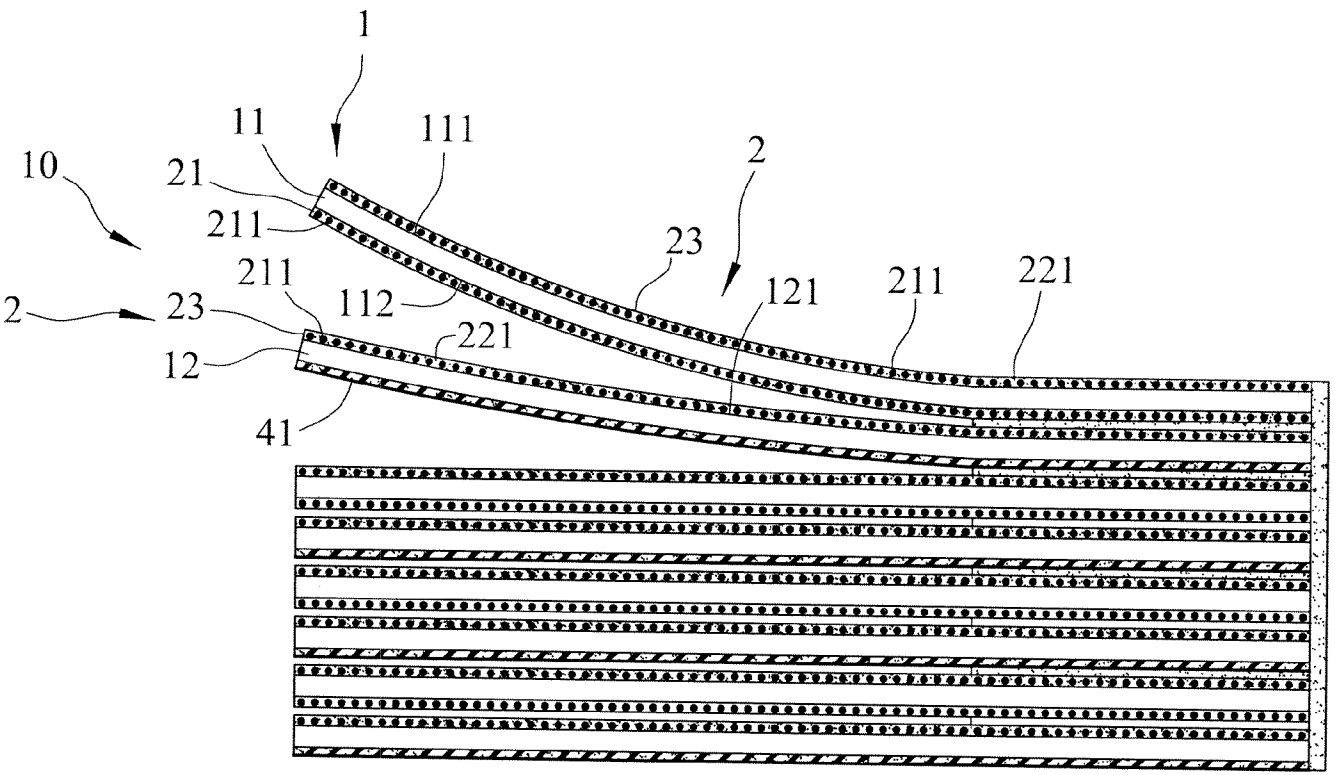
FIG. 10 is a cross-sectional view of a carbonless copy note pad according to a sixth embodiment of the present invention.

FIG. 10 shows a carbonless copy note pad 1 according to a sixth embodiment of the present invention. The sixth embodiment is similar to the fourth embodiment. In this embodiment, one of the color-developing coating layers 2 is formed on the writing surface 111 of the first paper sheet 11, and the other one of the color-developing coating layers 2 includes a microcapsule sublayer 21 and a mixing sublayer 23. The microcapsule sublayer 21 has the microcapsules 211, and is formed on the back surface 112 of the first paper sheet 11. The mixing sublayer 23 has the microcapsules 211 and the carbonless color-developing material 221, and is formed on the upper surface 121 of the second paper sheet 12.

Figure 11:
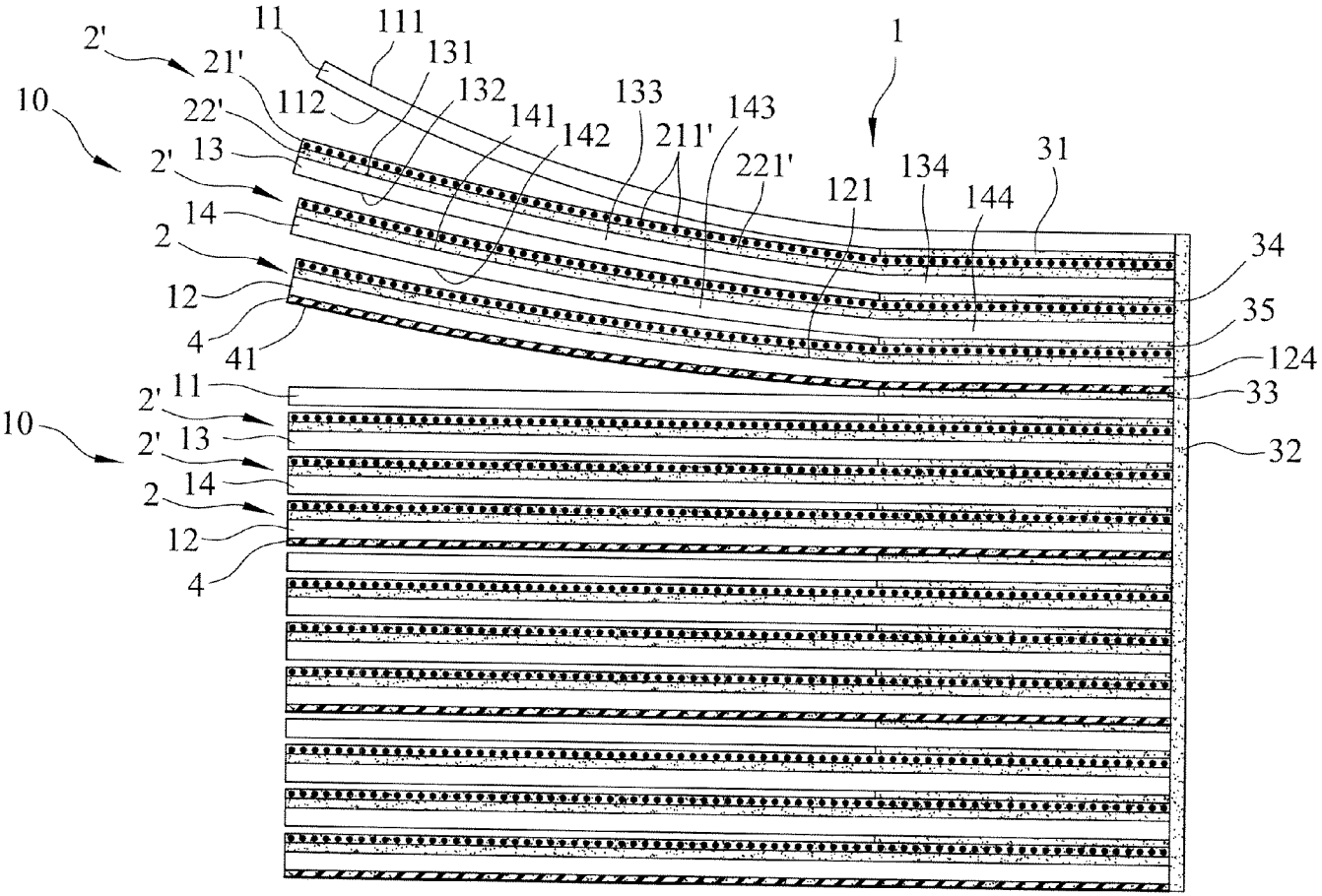
FIG. 11 is a cross-sectional view of a carbonless copy note pad according to a seventh embodiment of the present invention.

FIG. 11 shows a carbonless copy note pad 1 according to a seventh embodiment of the present invention. The seventh embodiment is similar to the first embodiment. In this embodiment, each of the note sheet sets 10 further includes upper and lower intervening paper sheets 13, 14, two additional color-developing coating layers 2', and upper and lower additional adhesive layers 34, 35. Each of the upper and lower intervening paper sheets 13, 14 has an upward surface 131 or 141 to face the first paper sheet 11 and a downward surface 132 or 142 to face the second paper sheet 12, and includes a flippable part 133 or 143 and a re-adherable part 134 or 144.

The additional color-developing coating layers 2' are formed on the upward surfaces 131, 141 of the intervening paper sheets 13, 14, respectively. Each of the additional color-developing coating layers 2' is similar to the color-developing coating layers 2, and includes a microcapsule sublayer 21' having microcapsules 211' and a color-developing sublayer 22' having a carbonless color-developing material 221'.

The first adhesive layer 31 is releasably attached to the third re-adherable part 134 at the upward surface 131 of the upper intervening paper sheet 13.

The upper additional adhesive layers 34 is coated on the third re-adherable part 134 at the downward surface 132 of the upper intervening paper sheets 13 and is releasably attached to the third re-adherable part 144 at the upward surface 141 of the lower intervening paper sheet 14.

The lower additional adhesive layers 35 is coated on the third re-adherable part 144 at the downward surface 142 of the lower intervening paper sheet 14 and is releasably attached to the second re-adherable part 124 at the upper surface 121 of the second paper sheet 12.

The present invention will now be explained in more detail below by way of the following examples and comparative examples.

Example 1 (EX 1)

A carbonless copy note pad of Example 1 had a structure similar to the carbonless copy note pad of the first embodiment of this invention, i.e., each note sheet set 10 included first and second paper sheets 11, 12, first and second adhesive layers 31, 33, a color-developing coating layer 2, and a coarse particle coating layer 4. Each of the first and second paper sheets 11, 12 had a size of 150 mm×105 mm. The first paper sheet 11 had a paper base weight of 90 g/m$^2$, and the second paper sheet 12 had a paper base weight of 80 g/m$^2$. An upper surface 121 of the second paper sheet 12 was coated with the color-developing coating layer 2, and a lower surface 122 of the second paper sheet 12 was coated with the coarse particle coating layer 4. The second paper sheet 12, the color-developing coating layer 2, and the coarse particle coating layer 4 in combination had a total base weight of 99.8 g/m$^2$. The color-developing coating layer 2 included microcapsules (21.4 wt %), wheat starch (42.57 wt %), polyvinyl alcohol (10.82 wt %), a carbonless color-developing material (salicylic acid resin) (16.19 wt %), and a calcium stearate (9.02 wt %,). The color-developing coating layer 2 was in an amount of 5.2 g/m$^2$. In each of the microcapsules, a reactive dye (crystal violet lactone, CVL) was enclosed in a microshell made of an amino-containing resin. The coarse particle coating layer 4 included clay (43.2 wt %), calcium carbonate (42.8 wt %), polyvinyl alcohol (7.0 wt %), latex (6.9 wt %), and coarse particles (0.8 wt %). A roughness of the coarse particle coating layer 4 was measured using a Parker print surface roughness tester (Model No. M590, Messmer Instruments Ltd.). The roughness and thickness of the coarse particle coating layer 4 are listed in Table 1.

The coarse particles were formed in a manner as described below. 80 g of a dispersing agent (polyacrylic acid type), 30 g of sodium dodecyl sulfate (SDS), and 2500 g of deionized water were added to and mixed in a 5-liter four-neck flask fitted with a thermometer, a cooler, and a stirrer. In another flask, 5 g of benzoyl peroxide (BPO) was evenly dissolved in a solution including 500 g of methyl methacrylate (MMA), 350 g of methyl acrylate (MA), 350 g of butyl acrylate, and 40 g of acrylic acid to obtain a mixture. The mixture was then added to the four-neck flask to mix with the contents therein at 280 rpm for 15 minutes. Thereafter, the contents in the four-neck flask were heated to and kept at 70° C. for 2 hours. Next, an exothermic reaction was allowed to take place, which caused the temperature in the four-neck flask to rise to 95° C. After the temperature dropped to 70° C., the contents in the four-neck flask were kept at 70° C. for 8 hours. When the temperature dropped to room temperature, the contents were filtered to thereby obtain coarse particles having an average particle size of about 40 μm to 120 μm.

Comparative Example 1 (CE 1)

A carbonless copy note pad of Comparative Example 1 was similar to that of Example 1, except that the coarse particle coating layer 4 was not coated on the second paper sheet 12 of each note sheet set 10. The second paper sheet 12 and the color-developing coating layer 2 in combination had a total base weight of 90.4 g/m$^2$.

Comparative Example 2 (CE 2)

A carbonless copy note pad of Comparative Example 2 was similar to that of Comparative Example 1, except that the second paper sheet 12 of each note sheet set 10 had a paper base weight of 90 g/m$^2$. The second paper sheet and the color-developing coating layer 2 in combination had a total base weight of 100.8 g/m$^2$.

Example 2 (EX 2)

A carbonless copy note pad of Example 2 was similar to that of Example 1, except that a thickness of the coarse particle coating layer 4 was 0.121 mm, and that each of the first and second paper sheets 11, 12 had a paper base weight of 90 g/m$^2$. The second paper sheet 12, the color-developing coating layer 2, and the coarse particle coating layer 4 in combination had a total base weight of 109.9 g/m$^2$. The roughness of the coarse particle coating layer 4 was measured and is listed in Table 1.

Example 3 (EX 3)

A carbonless copy note pad of Example 3 was similar to that of Example 2, except that a thickness of the coarse particle coating layer 4 was 0.127 mm. The second paper sheet 12, the color-developing coating layer 2, and the coarse particle coating layer 4 in combination had a total base weight of 117.3 g/m$^2$. The roughness of the coarse particle coating layer 4 was measured and is listed in Table 1.

Example 4 (EX 4)

A carbonless copy note pad of Example 4 was similar to that of Example 2, except that a thickness of the coarse particle coating layer 4 was 0.131 mm. The second paper sheet 12, the color-developing coating layer 2, and the coarse particle coating layer 4 in combination had a total base weight of 117.9 g/m$^2$. The roughness of the coarse particle coating layer 4 was measured and is listed in Table 1.

Example 5 (EX 5)

A carbonless copy note pad of Example 5 was similar to that of Example 2, except that a thickness of the coarse particle coating layer 4 was 0.149 mm. The second paper sheet 12, the color-developing coating layer 2, and the coarse particle coating layer 4 in combination had a total base weight of 142.7 g/m$^2$. The roughness of the coarse particle coating layer 4 was measured and is listed in Table 1.

Comparative Example 3 (CE 3)

A carbonless copy note pad of Comparative Example 3 was similar to that of Example 2, except that the coarse particle coating layer 4 did not include the coarse particles. The coarse particle coating layer 4 included clay (43.2 wt %), calcium carbonate (42.8 wt %), polyvinyl alcohol (7.0 wt %), and latex (6.9 wt %). The second paper sheet 12, the color-developing coating layer 2, and the coarse particle coating layer 4 in combination had a total base weight of 109.3 g/m$^2$. The roughness and thickness of the coarse particle coating layer 4 were measured and are listed in Table 1.

Example 6 (EX 6)

A carbonless copy note pad of Example 6 was similar to that of Example 2, except that a thickness of the coarse particle coating layer 4 was 0.125 mm. The second paper sheet 12, the color-developing coating layer 2, and the coarse particle coating layer 4 in combination had a total base weight of 108.2 g/m$^2$. The roughness of the coarse particle coating layer 4 was measured and is listed in Table 1.

Example 7 (EX 7)

A carbonless copy note pad of Example 7 was similar to that of Example 6, except that the coarse particle coating layer 4 included clay (42.2 wt %), calcium carbonate (41.8 wt %), polyvinyl alcohol (6.8 wt %), latex (6.8 wt %), and coarse particles (2.4 wt %). The second paper sheet 12, the color-developing coating layer 2, and the coarse particle coating layer 4 in combination had a total base weight of 107.2 g/m$^2$. The roughness and thickness of the coarse particle coating layer 4 were measured and are listed in Table 1.

Example 8 (EX 8)

A carbonless copy note pad of Example 8 was similar to that of Example 6, except that the coarse particle coating layer 4 included clay (39.4 wt %), calcium carbonate (39.1 wt %), polyvinyl alcohol (6.4 wt %), latex (6.3 wt %), and coarse particles (8.8 wt %). The second paper sheet 12, the color-developing coating layer 2, and the coarse particle coating layer 4 in combination had a total base weight of 109.1 g/m$^2$. The roughness and thickness of the coarse particle coating layer 4 were measured and are listed in Table 1.

Typewriter Intensity Test

Each of the carbonless copy note pads of Examples 1-8 and Comparative Examples 1-3 was subjected to a typewriter intensity test for evaluating the color developing effect of the second paper sheets 12 of the topmost two of the note sheet sets 10 (first and second note sheet sets 10). Details of the test are disclosed in, e.g., U.S. Pat. No. 4,087,376. In this test, instead of a typewriter, a dot matrix printer (EPSON LQ-2080C) with a pressure set to be close to that of human writing (i.e., the scale of the printer was set to zero) was used to print characters on the first and second note sheet sets 10 together. Thereafter, Hunter Whiteness values (HW values) of the second paper sheets 12 of the first and second note sheet sets 10 of the carbonless copy note pad 1 in each of the Examples and the Comparative Examples were measured using an automatic reflectometer (Model TR-600, Tokyo Denshoku K. K.) for evaluating the color developing effect. Such reflectometer was also used in U.S. Pat. No. 4,784,982 for measuring Hunter whiteness.

In all the Examples and the Comparative Examples, an original HW value of the background (unprinted area) of each second paper sheet 12 was about 80-85, and the HW values of the characters on each second paper sheet 12 after standing for 20 seconds (initial time) and 4 minutes 40 seconds (aged time) were measured to calculate ΔHW values.

ΔHW value=[(original HW value−HW value of printed characters)/original HW value]×100%

For this test, the higher the ΔHW value of the printed characters, the darker the color developed in the characters. The ΔHW value of the Examples and the Comparative Examples are listed in Table 1.

TABLE 1

| | Second paper sheet | | | | Second paper sheet of first note sheet set | | Second paper sheet of second note sheet set | |
|---|---|---|---|---|---|---|---|---|
| | Paper base weight ($g/m^2$) | Total Base weight ($g/m^2$) | Coarse particle coating layer Roughness (μm) | Coarse particle coating layer Thickness (mm) | ΔHW (%) Initial | ΔHW (%) Aged | ΔHW (%) Initial | ΔHW (%) Aged |
| EX 1 | 80 | 99.8 | 5.09 | 0.124 | 10.8 | 11.9 | 3.1 | 3.2 |
| CE 1 | 80 | 90.4 | No coarse particle | | 11.0 | 12.1 | 5.8 | 5.9 |
| CE 2 | 90 | 100.8 | coating layer | | 10.2 | 11.4 | 5.5 | 5.6 |
| EX 2 | 90 | 109.9 | 5.01 | 0.121 | 10.8 | 11.4 | 2.8 | 2.9 |
| EX 3 | 90 | 117.3 | 5.06 | 0.127 | 10.4 | 11.6 | 2.6 | 2.8 |
| EX 4 | 90 | 117.9 | 5.07 | 0.131 | 10.2 | 11.2 | 1.8 | 1.8 |
| EX 5 | 90 | 142.7 | 4.94 | 0.149 | 10.4 | 11.9 | 1.2 | 1.4 |
| CE 3 | 90 | 109.3 | 3.65 | 0.122 | 9.7 | 10.5 | 5.3 | 5.5 |
| EX 6 | 90 | 108.2 | 5.05 | 0.125 | 10.6 | 11.8 | 2.8 | 2.9 |
| EX 7 | 90 | 107.2 | 8.81 | 0.126 | 10.5 | 11.2 | 1.6 | 1.6 |
| EX 8 | 90 | 109.1 | 14.03 | 0.128 | 10.5 | 11.3 | 1.2 | 1.5 |

It is noted that in the carbonless copy note pads of EX 1 and CE 1, the first paper sheets had the same paper base weight of 90 $g/m^2$, and the second paper sheets had the same paper base weight of 80 $g/m^2$. The coarse particle coating layer was merely formed on the lower surface of each second paper sheet of EX 1. The ΔHW values (initial and aged) of the second paper sheets in the first note sheet sets of the carbonless copy note pads of EX 1 and CE 1 are substantially the same, showing that a replica of the characters exhibited on the second paper sheet of the first note sheet set in the carbonless copy note pad of EX 1 is as clear as that in the first note sheet set of the carbonless copy note pad of CE 1. The ΔHW values (initial and aged) of the second paper sheet in the second note sheet set of the carbonless copy note pad of EX 1 are much smaller than those of the carbonless copy note pad of CE 1. It should be noted that the lower the ΔHW value of the second paper sheet in the second note sheet set, the lighter/fainter the characters exhibited thereon. It is evident that the coarse particle coating layer can effectively disperse the scribbling pressure.

In the carbonless copy note pads of EX 1 and CE 2, the first paper sheets had the same paper base weight of 90 $g/m^2$. In the carbonless copy note pad of EX 1, the second paper sheet had a paper base weight of 80 $g/m^2$, and the second paper sheet, the color-developing coating layer, and the coarse particle coating layer in combination had a total base weight of 99.8 $g/m^2$. In the carbonless copy note pad of CE 2, the second paper sheet had a paper base weight of 90 $g/m^2$, and the second paper sheet and the color-developing coating layer in combination had a total base weight of 100.8 $g/m^2$. The coarse particle coating layer was merely formed on the lower surface of each second paper sheet in the carbonless copy note pad of EX 1. It can be found that when the second paper sheets had almost the same total base weight, the ΔHW values (initial and aged) of the second paper sheet of the second note sheet set in the carbonless copy note pad of EX 1 are much smaller than those in the carbonless copy note pad of CE 2. This demonstrates that the carbonless copy note pad of EX1 provided with the coarse particle coating layer can better prevent the scribbling pressure 1 from acting on the underlying sheets, i.e., disperse the scribbling pressure, than the carbonless copy note pad of CE 2 in which the second paper sheet has an increased paper base weight.

In the carbonless copy note pads of EX 2 to EX 5, the coarse particle coating layers had substantially the same roughness (4.94 μm~5.07 μm) but different thicknesses (0.121 mm~0.149 mm). It can be noted that with the increase in thickness of the coarse particle coating layer, the coarse particle coating layer can more effectively disperse the scribbling pressure.

In the carbonless copy note pads of CE 3 and EX 6 to EX 8, the coarse particle coating layers had similar thicknesses (ranging from 0.122 mm to 0.128 mm), and different roughness (ranging from 3.65 μm to 14.03 μm). It can be noted that with the increase in roughness of the coarse particle coating layer, the coarse particle coating layer can more effectively disperse the scribbling pressure.

While the present invention has been described in connection with what are considered the most practical embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A carbonless copy note pad comprising:

a stack of note sheet sets each of which includes:

a first paper sheet having a writing surface and a back surface opposite to said writing surface;

a second paper sheet having an upper surface to face said back surface of said first paper sheet, and a lower surface opposite to said upper surface;

at least one color-developing coating layer formed on at least one of said first and second paper sheets; and a coarse particle coating layer which is formed on said lower surface of said second paper sheet, and which has a roughened surface such that a scribbling pressure resulting from a scribbling movement on said writing surface of said first paper sheet is dispersed so as to prevent the scribbling pressure from acting on said next one of said note sheet sets, wherein said coarse particle coating layer is a coarse particle-containing binder layer.

2. The carbonless copy note pad according to claim 1, wherein said roughened surface of said coarse particle coating layer has a roughness not less than 5 μm.

3. The carbonless copy note pad according to claim 1, wherein said coarse particle-containing binder layer includes a binder and a plurality of coarse particles dispersed in the binder.

4. The carbonless copy note pad according to claim 3, wherein said coarse particle-containing binder layer further includes clay and calcium carbonate.

5. The carbonless copy note pad according to claim 3, wherein said binder is selected from the group consisting of a polyvinyl alcohol-based binder, a latex-based binder, a starch-based binder, and a combination thereof.

6. The carbonless copy note pad according to claim 3, wherein said coarse particles have particle sizes are not less than 20 μm.

7. The carbonless copy note pad according to claim 1, wherein said color-developing coating layer is formed on said upper surface of said second paper sheet.

8. The carbonless copy note pad according to claim 1, wherein said color-developing coating layer includes a plurality of microcapsules and a carbonless color-developing material, each of said microcapsules encapsulating a reactive dye and being rupturable.

9. The carbonless copy note pad according to claim 8, wherein said color-developing coating layer includes a microcapsule sublayer having said microcapsules, and a color-developing sublayer which has said carbonless color-developing material, and which is formed on said upper surface of said second paper sheet.

10. The carbonless copy note pad according to claim 9, wherein said microcapsule sublayer is formed on said back surface of said first paper sheet.

11. The carbonless copy note pad according to claim 9, wherein said microcapsule sublayer is formed on said color-developing sublayer.

12. The carbonless copy note pad according to claim 9, wherein said color-developing coating layer includes two of said microcapsule sublayers, one of which is formed on said back surface of said first paper sheet, and the other of which is formed on said color-developing sublayer.

13. The carbonless copy note pad according to claim 8, wherein each of said note sheet sets includes two of said color-developing coating layers, one of which is formed on said writing surface of said first paper sheet, and the other of which is formed on said second paper sheet.

14. The carbonless copy note pad according to claim 1, wherein said at least one of said color-developing coating layer is formed on said second paper sheet, and each of said note sheet sets further includes at least one intervening paper sheet which is disposed between said first and second paper sheets, and which has an upward surface to face said first paper sheet and a downward surface to face said second paper sheet, and an additional color-developing coating layer formed on said upward surface of said intervening paper sheet.

15. The carbonless copy note pad according to claim 1, wherein said first paper sheet includes a first flippable part and a first re-adherable part, said second paper sheet including a second flippable part and a second re-adherable part, said carbonless copy note pad further including a first adhesive layer which is coated on said first re-adherable part at said back surface of said first paper sheet, and which is releasably attached to said second re-adherable part at said upper surface of said second paper sheet, and a second adhesive layer which is coated on said second re-adherable part at said lower surface of said second paper sheet, and which is releasably attached to said next one of said note sheet sets.

16. The carbonless copy note pad according to claim 15, wherein a first bonding force between said first adhesive layer and said second re-adherable part is greater than a second bonding force between said second adhesive layer and said next one of said note sheet sets.

17. A carbonless copy note pad comprising:

a stack of note sheet sets each of which includes:

a first paper sheet having a writing surface and a back surface opposite to said writing surface;

a second paper sheet having an upper surface to face said back surface of said first paper sheet, and a lower surface opposite to said upper surface;

a first adhesive layer which is permanently bonded to said back surface of said first paper sheet, and which is releasably attached to said upper surface of said second paper sheet;

a color-developing coating layer formed on at least one of said first and second paper sheets; and a coarse particle coating layer which is formed on said lower surface of said second paper sheet, and which has a roughened surface such that a scribbling pressure resulting from a scribbling movement on said writing surface of said first paper sheet is dispersed so as to prevent the scribbling pressure from acting on said next one of said note sheet sets, each of said first and second paper sheets having a side edge, said side edges of said first and second paper sheets of said note sheet sets being flush with each other and being bonded together by gluing, wherein said coarse particle coating layer is a coarse particle-containing binder layer.

* * * * *